US006290064B1

(12) United States Patent
Kuhn et al.

(10) Patent No.: US 6,290,064 B1
(45) **Date of Patent: *Sep. 18, 2001**

(54) COLLAPSIBLE SHIPPING CONTAINER HAVING A WALK-IN BASE

(75) Inventors: Dean C. Kuhn, Sarver; James C. Abinanti, Pittsburgh, both of PA (US)

(73) Assignee: PPG Industries Ohio, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/400,782

(22) Filed: Sep. 22, 1999

Related U.S. Application Data

(60) Provisional application No. 60/101,593, filed on Sep. 24, 1998.

(51) Int. Cl.[7] ..... B65D 19/00

(52) U.S. Cl. ..... 206/600; 206/448; 206/454; 108/56.1; 220/4.28

(58) Field of Search ..... 206/386, 598, 206/600, 449, 454, 335, 448; 108/55.1, 55.3, 56.1, 56.3, 57.13; 220/1.5, 4.28, 4.33; 211/41.1, 41.14, 117

(56) References Cited

U.S. PATENT DOCUMENTS

| | | | | |
|---|---|---|---|---|
| 3,029,952 | * | 4/1962 | Bagdon et al. | 211/117 |
| 3,129,820 | * | 4/1964 | Stulman | 211/117 |
| 3,963,122 | * | 6/1976 | Pater et al. | 206/454 |
| 4,007,837 | | 2/1977 | Rowley et al. . | |
| 4,010,849 | | 3/1977 | Pater et al. . | |
| 4,097,359 | * | 6/1978 | Davitz | 211/117 |
| 4,922,834 | * | 5/1990 | Kraus | 206/386 |
| 5,147,050 | * | 9/1992 | Cullen | 211/117 |
| 5,555,980 | * | 9/1996 | Johnston et al. | 206/600 |
| 5,597,084 | * | 1/1997 | Parasin | 206/600 |
| 5,641,076 | * | 6/1997 | Englund | 206/454 |
| 5,676,066 | | 10/1997 | Cavalier et al. . | |

FOREIGN PATENT DOCUMENTS

| | | | | |
|---|---|---|---|---|
| 0 376 799 | | 7/1990 | (EP) . | |
| 4311488 | * | 11/1992 | (JP) | 206/454 |
| 93/17930 | | 9/1993 | (WO) . | |
| 98/7073 | | 8/1998 | (ZA) . | |

OTHER PUBLICATIONS

Drawing No. 537791 dated Aug. 16, 1993.
Packaging Part Specification—Part Name—Support Cradle (Export), pp. 1–3.

* cited by examiner

*Primary Examiner*—Paul T. Sewell
*Assistant Examiner*—Luan K. Bui
(74) *Attorney, Agent, or Firm*—Donald C. Lepiane

(57) ABSTRACT

The invention relates to a collapsible container for shipping articles such as automotive transparencies, more particularly automotive windshields and in particular, to a base having a cut out portion. The cut out portion allows a person loading and/or unloading the container to walk on the floor supporting the base for ease of loading/unloading articles on the base at the rear of the container.

15 Claims, 4 Drawing Sheets

COLLAPSIBLE SHIPPING CONTAINER HAVING A WALK-IN BASE

This application claims the benefit of U.S. Provisional Application No. 60/101,593, filed Sep. 24, 1998.

FIELD OF THE INVENTION

This invention relates to a collapsible container for shipping articles, e.g. windshields, and, more particularly, to a collapsible container for shipping windshields that has walk-in base.

DISCUSSION OF THE TECHNICAL PROBLEM

At the present time there are available collapsible containers e.g. from Clip-Lok SimPak USA, Inc. of Atlanta, Ga., for shipping articles e.g. glass sheets. The collapsible container has a base connected to walls, and the walls connected to a lid or top, by spring steel clips. The base of the presently available collapsible containers has no provisions for a person to walk through the base to retrieve articles at the rear of the container. In other words, the base has a solid deck; it does not have a portion removed or cut-out to provide a walk-in base.

With the presently available container having a solid base, to retrieve articles at the rear of the container, it may be necessary to step up onto the base, retrieve the article, and step off the base carrying the article. The reverse procedure is employed to load the container. When the foregoing techniques are practiced, the loading and unloading is ergonomically unacceptable. One solution is to reduce the depth of the base; this option is not always acceptable because it reduces the pay load of the container.

As can be appreciated by those skilled in the art, it would be advantageous to provide a collapsible container with a walk-in base to eliminate the limitations of a solid base.

SUMMARY OF THE INVENTION

The invention relates to an improved base of a collapsible shipping container of the type having sidewalls, a backwall, a frontwall and a lid held together and to the improved base in any convenient manner, e.g. by spring clips of the type sold by Clip-Lok SimPak USA, Inc. The base has a generally parallelepiped outer shape and a cut out portion in the front side of the base to allow the person unloading the rack to walk on the floor rather than on the base for ease of loading and/or unloading articles e.g. automotive transparencies such as windshields on the base. The base may be made of any material for example, wood, reinforced plastic, steel members and preferably steel tubing.

The invention also relates to a method of loading and/or unloading articles from a collapsible container having the base of the invention.

DETAILED DESCRIPTION OF THE INVENTION

The instant invention relates to a collapsible container for shipping articles, in particular sheets made of any material, such as glass and more particularly, to automotive transparencies such as side windows, rear windows, roof windows and windshields. As will be appreciated, the invention is not limited to the type of articles placed in or loaded on the container embodying features of the invention, and in the following discussion, the articles are windshields; however, as will be appreciated the invention is not limited thereto.

Figure 1:
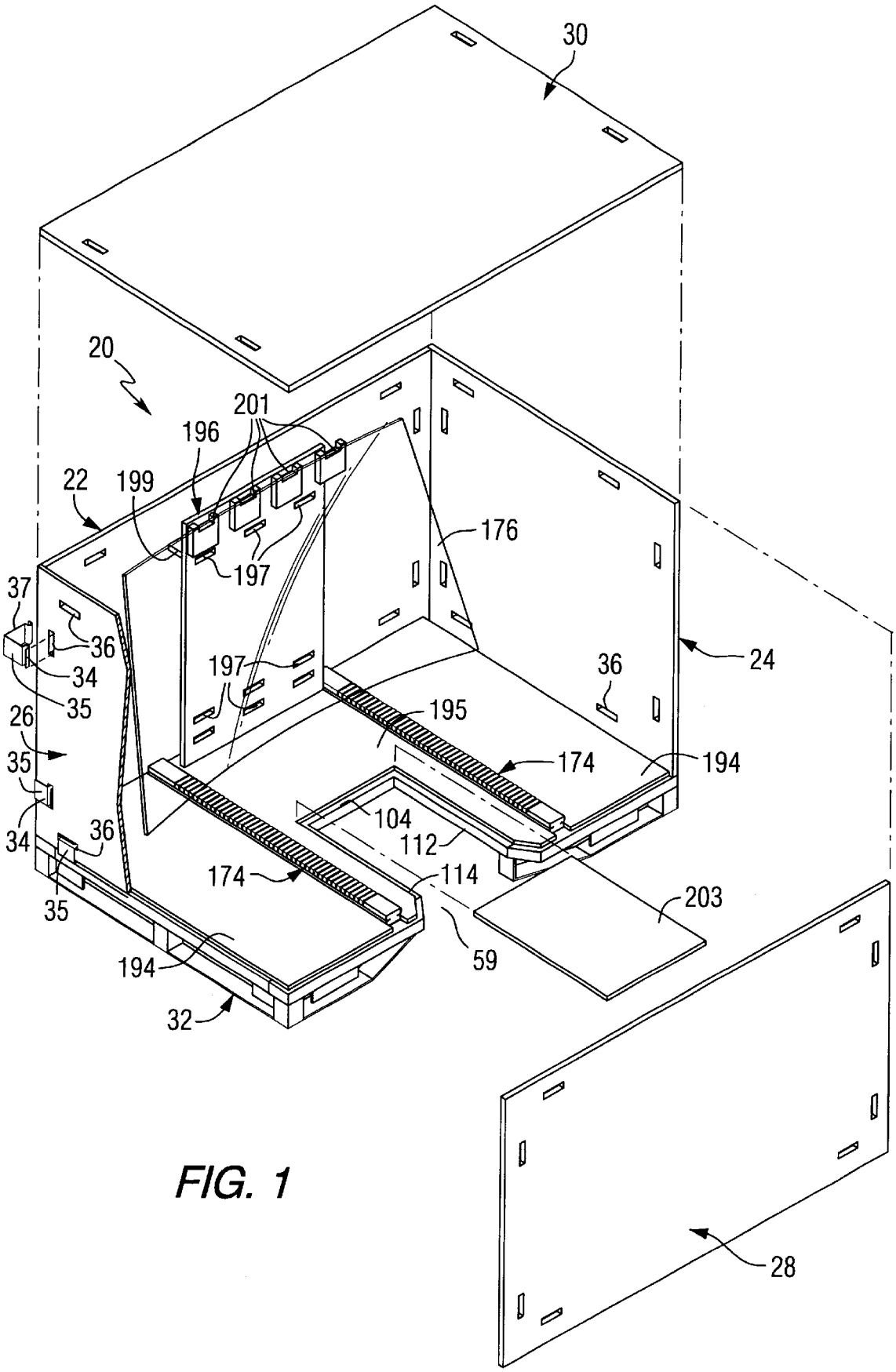
FIG. 1 is an isometric view of a shipping container having portions removed for purposes of clarity and having components spaced from one another to illustrate features of the invention.

With reference to FIG. 1, there is shown collapsible container 20 incorporating features of the invention. The container 20 includes a backwall 22, a right sidewall 24, a left sidewall 26, a frontwall 28, a lid or cap 30 and a base 32. The walls 22, 24, 26 and 28, the cap 30 and the base 32 may be secured together in any convenient manner. In the preferred practice of the invention the walls 22, 24, 26, and 28, the cap 30 and the base 32 are held together by L-shaped spring clips 34 (shown more clearly in FIG. 2) of the type sold by Clip-Lok SimPak USA., Inc. as Part No. PS020298. For example and with reference to FIG. 1., in particular viewing the left sidewall 26 and the backwall 22, the clip 34 has the end of one leg e.g., leg 35 secured in a slot 36 adjacent the upper portion of the sidewall 26, and the end of the other leg e.g., leg 37 (see FIG. 2) in the slot adjacent the upper portion of the backwall 22. The end of the leg 35 of another clip 34 is inserted in a slot 36 at the bottom end of the sidewall 26 as viewed in FIG. 1 and the end of the leg 37 is captured on the base 32 in a manner discussed below.

As can be appreciated by those skilled in the art, the invention is not limited to the number of clips 34 used to secure the container walls together and to the lid and the base. In the practice of the invention, it is preferred to have at least two clips at each of the container walls and the cap, thereby requiring two slots spaced from one another adjacent each top edge of the walls 22, 24, 26 and 28, and two spaced from one another along each edge of the cap 30. Provisions on the base 32 for engagement of the legs of the clip 34 are discussed below.

As can further be appreciated by those skilled in the art, the walls 22, 24, 26 and 28 and lid 30 may be made of any material. The material selected should have sufficient structural stability to compress packing material or dunnage against the articles e.g. the windshields loaded in the container to provide a unitized pack. In the preferred practice of the invention, the walls and lid are made of ¾ inch plywood; however, other materials such as metal or wheat-straw composite panel sold under the mark ISOBORD may be used. The slots 36 shown in the drawing extend through the thickness of the sidewalls and top. However, in the practice of the invention, it is preferred that the slots extend partially but not completely through to the thickness of the sidewalls to provide a groove in the sidewalls.

In the following discussion, the base of the invention will be discussed as part of a container using the backwall 22, sidewalls 24 and 26, frontwall 28, cap 30 and the clips 34 of the type sold by Clip-Lok SimPak USA., Inc.

Figure 3:
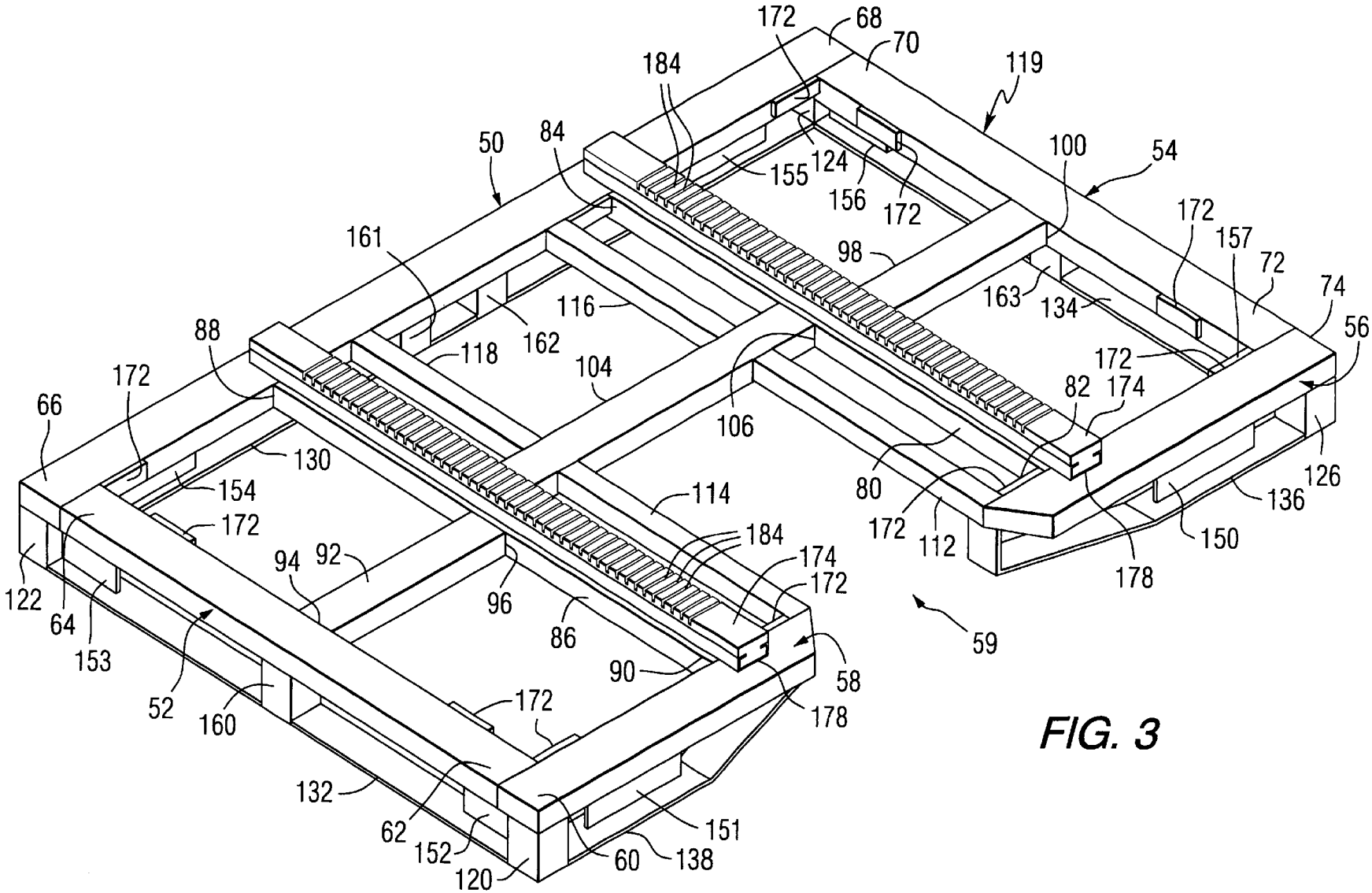
FIG. 3 is an isometric view of the base incorporating features of the invention; the base is a component of the shipping container shown in FIG. 1.

With reference to FIG. 3, the discussion will now be directed to the base 32 incorporating features of the invention. The base 32 includes a rear linear member or rear strut 50, a left side linear member or left strut 52, a right side linear member or right strut 54, a right front sectional member or right sectional strut 56 and a left front sectional member or left sectional strut 58 and cut out 59. End 60 of the left sectional strut 58 is joined to end 62 of the left strut 52; end 64 of the left strut 52 is joined to end 66 of the rear strut 50; end 68 of the rear strut 50 is joined to end 70 of the right strut 54, and end 72 of the right strut 54 is joined to end 74 of the right sectional strut 56.

To provide internal structural stability, it is recommended that the base be provided with an internal structural system. More particularly, a right cross member 80 has one end joined to the right sectional strut 56 at 82 and the other end to the rear strut 50 at 84, a left cross member 86 has one end joined to the rear strut 50 at 88 and the other end to the left sectional strut 58 at 90; a left side cross member 92 has one end joined at 94 to the left strut 52 and the other end to the left cross member 86 at 96; a right side cross member 98 has one end joined to the right strut 54 at 100 and the other end to the right cross member 80 (joining area not shown); a center cross member 104 has one end joined to the right cross strut at 106 and the other end to left cross member 86 (joining area not shown).

Although not limiting to the invention, to prevent damage to the bottom of the windshields loaded on the base 32 when the container is lifted by the forks of a fork lift truck, a structural guide bar 112 is secured to the end of the right sectional strut 56 and the cross member 104; a structural guide bar 114 is secured between the left sectional strut 58 and the cross member 104; a structural guide bar 116 between the rear strut 50 and the cross member 104 adjacent the cross member 86, and a structural guide bar 118 is secured between the rear strut 50 and the cross member 104 adjacent the cross member 80. The struts 50, 52, 54, 56, and 58; the cross members 80, 86, 92, 98 and 104, and the structural guide bars 112, 114, 116 and 118 form deck portion 119 of the base 32.

The cut out portion 59 is defined by struts 112, 114 and 104 and ends of the struts 56 and 58 as viewed in FIG. 3.

As can be appreciated, the invention is not limited to the peripheral dimensions of the base 32. In the practice of the invention a deck portion 66½ inches (169 centimeters (cm)) by 44¾ inches (114 cm) was constructed. The distance between the adjacent ends of the sectional struts 56 and 58 was about 15 inches (38.1 cm) and the distance from the sectional struts and the middle cross member 104 was about 23¾ inches (60 cm) i.e. the depth of the cut out 59. The struts 50, 52, 54, 56, and 58, and the cross members 80, 86, 92, 98, and 104 were made of 14 gauge 3 inches (7.6 cm) by 1½ inches (3.8 cm) rectangular steel tubing. The structural guide bars 112, 114, 116 and 118 were each made of 11 gauge 1½ inch (3.8 cm) square steel tubing.

Figure 2:
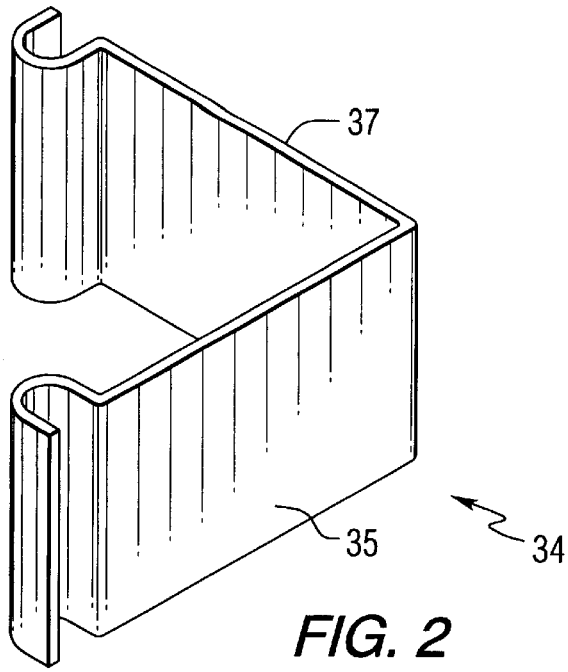
FIG. 2 is an isometric view of a clip that may be used in the practice of the invention.

The deck portion 119 of the base 32 was held above the floor to move forks of a fork lift truck under the deck portion 119 by vertical legs 120, 122, 124 and 126 secured at the corners of and beneath the deck portion 119 as shown in FIG. 3. The legs 120, 122, 124 and 126 were made of 14 gauge 2½ inch (6.4 cm) square steel tubing having a height of about 3¼ inches (8.3 cm). Safety straps 130, 132 and 134 are provided under the struts 50, 52 and 54 respectively, between and secured to the vertical legs 120 and 124, 122 and 120, and 124 and 126 respectively, and safety straps 136 and 138 were also provided under sectional struts 56 and 58 respectively, to prevent the container from tipping off the forks of a fork lift truck when the container is lifted above the floor. The safety strap 136 and 134 under the sectional strut 56 and 58, respectively, extend from their respective vertical leg 126 and 120 under the respective strut and the strap adjacent the end of their respective sectional strut angled toward the rear strut 50 and was bent upward and was secured at the juncture of the guide bars 112 and 114 and the sectional strut 56 and 58 respectively as shown in FIG. 2. The safety straps 130, 132, 134, 136, and 138 were made of flat ¼ inch (0.64 cm) hot rolled steel (HRS) plate 2½ inches (6.4 cm) wide.

Additional structural support to prevent bowing of the struts of the deck portion 119 included gusset plates 150, 151, 152, 153, 154, 155, 156 and 157, and vertical legs 160, 161, 162 and 163 between the deck portion 119 of the base 32 and the straps as shown in FIG. 3. Although not limiting to the invention the gusset plates were made of ¼ HRS plate 3 inches (7.6 cm) high. The gusset plates 150, 151, 154 and 155 were 8 inches (20.3 cm) long, and the gusset plates 152, 153, 156 and 157 were 5 inches (12.7 cm) long. The vertical supports 160, 161, 162, 163 were made of 14 gauge 2½ inch (6.4 cm) square steel tubing and were 3 inches (7.6 cm) high.

To secure the end of a leg of the clip 34 in position on the base 32, 16 gauge ½ inch (1.27 cm) by 1 inch (2.54 cm) by 3½ (8.9 cm) inches long steel clip retainers 172 are secured on the inner surface of the struts 50, 52, 54, 56 and 58 as shown in FIG. 3. The position of the clip retainers 172 was adjacent the bottom edge of the strut to which it is joined. One leg of the clips 34 e.g., the leg 35 is positioned in the slots 36 adjacent the bottom edge of the walls 22, 24, 26 and 28 as viewed in FIG. 1 with the other leg of the clip 34, e.g. the leg 37 under the struts 50, 52, 54, 56 and 58 with the end of the leg 37 engaging the clip retainers 172. In the practice of the invention, the slots for receiving a leg of the clip did not extend through the thickness of the sidewalls and top. As can be appreciated the clip retainer 172 may be eliminated by increasing the size of the struts or reducing the length of the leg of the clip. Increasing the size of the struts increases the weight of the base and reducing the leg of the clip would require different size clips. Using the clip retainers provides for using one size clip and not increasing the weight of the base.

Figure 4:
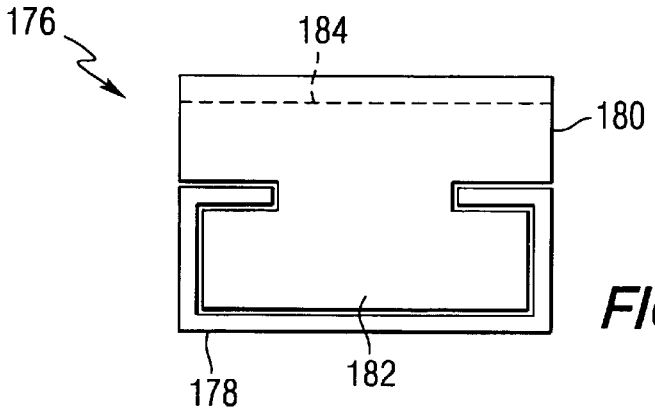
FIG. 4 is an end view of a runner that may be used in the practice of the invention.
Figure 5:
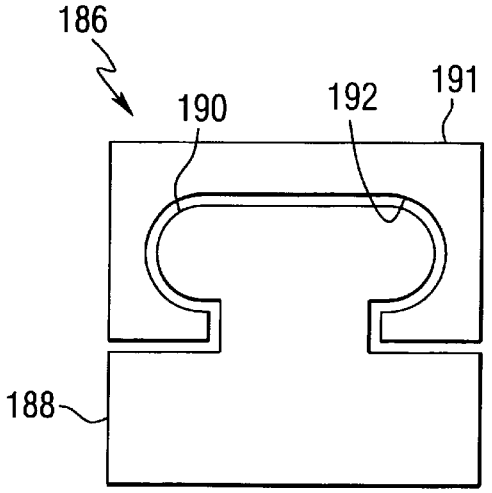
FIG. 5 is a view similar to the view of FIG. 4 showing an alternative runner that may be used in the practice of the invention.

Runners 174 of the type used in the art are provided on the base 32 to receive the bottom edges of the windshields 176 to support the windshields in the vertical position as viewed in FIG. 1. With continued reference to FIG. 3, the runners are provided on the deck portion 119 of the base. With reference to FIG. 4, the runners 176 include a C-channel 178, 42 inches (106.7 cm) long, made of 10 gauge steel having a height of 11/16 inch (1.7 cm), a width of 1⅞ inches (4.8 cm) and a ⅝ inch (1.6 cm) opening. A C-channel 178 is secured over and to each of the cross member 80 and 86. A molded urethane plastic insert 180 has a T shape on the bottom surface 182 and a plurality of slots 184 on the upper surface as viewed in FIG. 4. The T shaped surface 182 is slipped into the C-channel 178 to capture the molded urethane insert 180 in the C-channel 178. As can be appreciated by those skilled in the art, the invention is not limited to the type of runners used to secure the bottom edges of the windshields. For example, shown in FIG. 5 is another type of runner 186 that may be used in the practice of the invention. The runner 186 includes a rail member 188 secured to each of the cross members 80 and 86 in a similar manner as the C-channel 178. The upper end of the rail member 188 as viewed in FIG. 5 has a radiused end 190 for receiving a molded urethane insert 191 having a circular cut out 192 as shown in FIG. 5.

The discussion will now be directed to loading the container 20 having the base 32 of the instant invention. With reference to FIG. 1, the sidewalls 24 and 26 and backwall 22 were secured to each other and to the base 32 by the spring clips 34. Two clips 34 were provided at each adjacent side of the sidewalls and the back wall, and two clips were provided at each edge of the backwall and sidewalls adjacent the base. Plywood sections 194 were provided over the left side and right side of the base as viewed in FIG. 1 between the sidewall and the adjacent runner. A section 195 of plywood was provided over the base between the runners with the cut out portion 59 left uncovered to provide access to the rear portion of the container.

Figure 6:
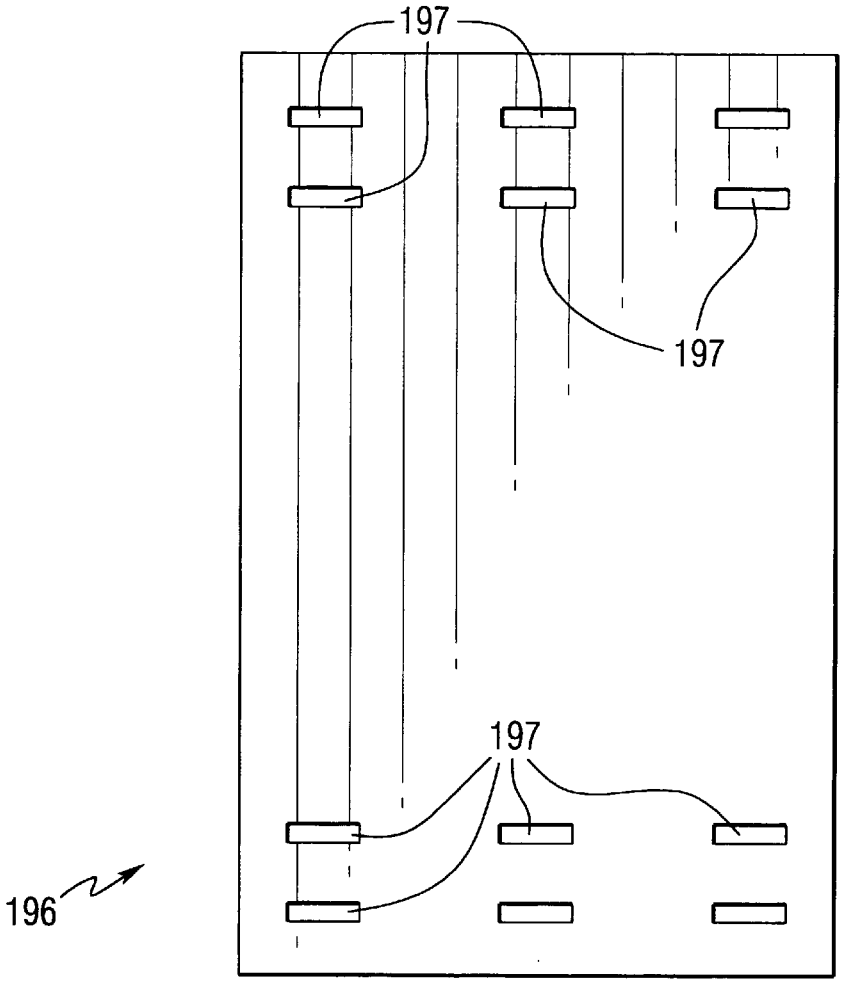
FIG. 6 is a plan view of a support cradle.
Figure 7:
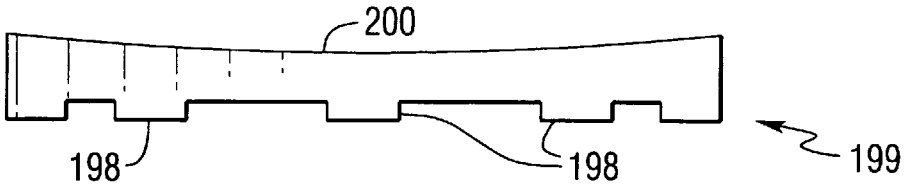
FIG. 7 is a plan view of a sheet engaging member having a concave engaging surface.
Figure 8:
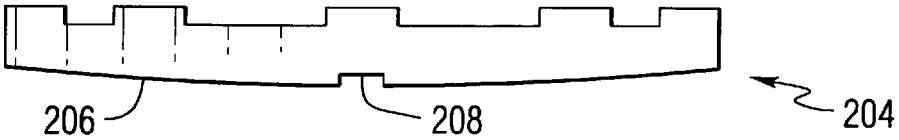
FIG. 8 is a plan view of a sheet engaging member having a convex sheet engaging surface.

A back support or back support cradle (see FIG. 6) 196 made of recycled paper sold under the name of HOMASOTE and having slots 197 to receive tabs 198 of support member 199 was rested against the backwall 22 as shown in FIG. 1. The windshields loaded on the base had a convex outer surface and the support member 199 had a concave shaped engaging surface 200 to engage the convex surface of the first loaded windshield. Windshields were loaded on the container by inserting the edges of the windshield in the slots 184 of the runners 176, hair pin separators 201 made of polyethylene of the type used in the art separated adjacent windshields. The windshields were loaded on the rear of the base by a person walking on the floor supporting the base into the cut out 59. As the center of the base was approached with windshields, a piece of plywood 203 was placed over the cut out 59. When the last windshield was loaded on the base 32, a front support (not shown) similar to the back support 196 was placed in the front of the last loaded windshield. The front support had support member 204 with a convex engaging surface 206 (see FIG. 8) with a cut out 208 to receive rear view mirror mount on the last loaded windshield. The front support engaged the concave surface of the last loaded windshield. As can be appreciated, instead of only one piece of plywood 203, several segments may be used to minimize stretching over the base to load the windshields.

Dunnage (not shown) of the type used in the art was placed between the windshields and the sidewalls. The bottom of the front wall 28 was secured to the base 32 by the clips 34. Dunnage was provided between the frontwall 28 and the front support; thereafter the frontwall 28 was biased toward the windshields to compress the dunnage. The frontwall 28 was secured to the sidewalls 24 and 26 by the clips 34. Dunnage was placed over the loaded windshields and the lid 30 urged toward the windshields to compress the dunnage. The lid 30 was secured to the sidewalls 24 and 26, the backwall 22 and the frontwall 28 by the clips 34.

The container is unloaded by reversing the steps practiced to load the container. After the container is unloaded, the walls and lid may be stacked on top of the base and secured thereto in any convenient manner for return shipment. The clips, hairpins, front and back supports and the dunnage may be placed in an assembled container for return shipment.

As can now be appreciated, the invention is not limited to the manner of securing the windshields in the container, e.g. the windshield may be unitized using straps or banding of the type used in the art, alone or in combination with dunnage. Further, as can be appreciated, the invention is not limited to the size of the elements of the components of the specific embodiments of the invention presented.

We claim:

1. A container for shipping sheets comprising:

a plurality of side sections;

a lid;

a base having a parallelepiped shape defined by a pair of sides, a back side and a front side, the base having a rear surface portion opposite the front side and the front side having a cut out portion for access to the rear surface portion of the base, wherein the base is made of interconnecting struts made of elongated parallelepiped hollow tubing;

a first runner extending from the first side of the base to the back side of the base and a second runner spaced from the first runner and extending from the front side of the base to the back side of the base, the runners each have grooves facing away from surface of the base to receive edge portions of sheets to be shipped wherein each of the runners is made of two sections, one section extending between the front and back sides of the base and the other section slideable over and captured on the first section, and clips for joining the side sections together, the side sections to the base and the lid to the side sections.

2. A container for shipping automotive transparencies comprising:

a plurality of a side section;

a lid;

a base having a parallelepiped shape defined by a pair of sides, a back side and a front side, the base having a rear surface portion opposite the front side and the front side having a cut out portion for access to the rear surface portion of the base, wherein the base is made of interconnecting struts made of elongated parallelepiped hollow tubing;

a first runner extending from the first side of the base to the back side of the base and a second runner spaced from the first runner and extending from the front side of the base to the back side of the base, the runners each have grooves facing away from surface of the base to receive edge portions of sheets to be shipped wherein each of the runners is made of two sections, one section extending between the front and back sides of the base and the other section slideable over and captured on the first section, and clips for joining the side sections together, the side sections to the base and the lid to the side sections.

3. A container for shipping articles comprising:

a plurality of side sections;

a lid;

a base having a parallelepiped shape defined by a pair of sides, a back side and a front side, the base having a rear surface portion opposite the front side and the front side having a cut out portion for access to the rear surface portion of the base, wherein upper surface of the base is covered by at least two cover sheets with one of the cover sheets overlaying the cutout portion and clips for joining the side sections together, the side section to the base and the lid to the side sections.

4. A container for shipping articles comprising:

a plurality of side sections;

a lid;

a base having a parallelepiped shape defined by a pair of sides, a back side and a front side, the base having a rear surface portion opposite the front side and the front side having a cut out portion for access to the rear surface portion of the base;

a back support cradle resting on the base and maintained in a vertical position at least by side section of the plurality of side sections joined to the back side of the base, the back support cradle comprising:

a vertical back support;

a support member; and an interlocking arrangement to interconnect the vertical back support and support member, the vertical back support having one part of the interlocking arrangement defined as the first part and the support member having another part of the interlocking arrangement defined as the second part, and clips for joining the side sections together, the side section to the base and the lid to the side sections.

5. The container of claim 4 wherein the side sections and lid are made of a rigid sheet material.

6. The container of claim 4 further including a pair of runners spaced from one another and mounted on the base, each runner extending from the front side of the base to the back side of the base.

7. The container of claim 6 wherein the runners have grooves facing away from surface of the base to receive edge portions of sheets to be shipped with the sheets to be shipped supported in the vertical position by the back support cradle.

8. The container of claim 4 wherein the first part of the interlocking arrangement is a slot and the second part of the interlocking arrangement is a tab insertable in the slot of the first part.

9. The container of claim 8 wherein the vertical back support includes a plurality of slots in a first portion of the vertical back support and a plurality of slots in a second portion of the vertical back support, the second portion of the vertical back support spaced from the first portion of the vertical back support and closer to the base than the first portion of the vertical back support and the support member secured to the first portion of the vertical back support and further including a second support member, the second support member secured to the second portion of the vertical back support.

10. The container of claim 9 wherein at least one of the support members has a concave surface.

11. The container of claim 4 wherein the second part of the interlocking arrangement is a slot and the first part of the interlocking arrangement is a tab insertable in the slot of the first part.

12. The container of claim 11 wherein the vertical back support includes a plurality of tabs in a first portion of the vertical back support and a plurality of tabs in a second portion of the vertical back support spaced from the first portion of the back support and closer to the base than the first portion of the back support and the support member secured to the first portion of the back support and further including a second support member, the second support member secured to the second portion of the vertical back support.

13. The container of claim 12 wherein at least one of the support members has a concave surface.

14. A container comprising:

a plurality of side sections;

a lid;

a base having a pair of sides, a back side and a front side, the base having a rear surface portion opposite the front side and the front side having a cut out portion for access to the rear surface portion of the base;

clips joining the side sections together, the side sections to the base and the lid to the side sections, and a back support cradle resting on the base and maintained in a vertical position at least by the side section joined to the back side of the base, the back support cradle comprising:

a vertical back support;

a support member; and an interlocking arrangement to connect the vertical back support and support member together, the vertical back support having one part of the interlocking arrangement defined as the first part and the support member having another part of the interlocking arrangement defined as the second part; and a plurality of sheets secured in the container, the sheets supported in the vertical position by the back support cradle.

15. The container of claim 14 wherein the sheets are automotive transparencies.

* * * * *